US007818978B2

(12) United States Patent
Ducoulombier et al.

(10) Patent No.: US 7,818,978 B2
(45) Date of Patent: Oct. 26, 2010

(54) VAPOUR COMPRESSION DEVICE AND METHOD OF PERFORMING AN ASSOCIATED TRANSCRITICAL CYCLE

(75) Inventors: Maxime Ducoulombier, Wasquehal (FR); Stéphane Colasson, Veurey-Voroize (FR)

(73) Assignee: Commissariat à l'Energie Atomique, Paris (FR)

( * ) Notice: Subject to any disclaimer, the term of this patent is extended or adjusted under 35 U.S.C. 154(b) by 193 days.

(21) Appl. No.: 11/984,800

(22) Filed: Nov. 21, 2007

(65) Prior Publication Data

US 2008/0127672 A1 Jun. 5, 2008

(30) Foreign Application Priority Data

Dec. 1, 2006 (FR) ..... 06 10507

(51) Int. Cl.
*F25B 41/00* (2006.01)

(52) U.S. Cl. ..... 62/513; 62/113

(58) Field of Classification Search ..... 62/113, 62/513

See application file for complete search history.

(56) References Cited

U.S. PATENT DOCUMENTS

| | | | | |
|---|---|---|---|---|
| 6,698,214 | B2 * | 3/2004 | Chordia | 62/114 |
| 2005/0044865 | A1 * | 3/2005 | Manole | 62/149 |
| 2006/0150646 | A1 * | 7/2006 | Aflekt et al. | 62/157 |

FOREIGN PATENT DOCUMENTS

DE 195 33 755 A1 3/1996

OTHER PUBLICATIONS

F. Meunier, "Refrigeration Carnot-type cycle based on isothermal vapour compression," *International Journal of Refrigeration*, vol. 29, No. 1, 2006, pp. 155-158.

A. Cavallini et al., "Two-stage transcritical carbon dioxide cycle optimization: A theoretical and experimental analysis," *International Journal of Refrigeration*, vol. 28, No. 8, 2005, pp. 1274-1283.

J.C. Goosmann et al., "Recent Improvements in $CO_2$ Equipment," *Refrigerating Engineering, The American Society of Refrigerating Engineers*, vol. 16, No. 1, 1928, pp. 1-10.

Gustav Lorentzen, "Revival of carbon dioxide as a refrigerant," *International Journal of Refrigeration*, vol. 17, No. 5, 1994, pp. 292-301.

* cited by examiner

*Primary Examiner*—Cheryl J Tyler
*Assistant Examiner*—Lakiya Rogers
(74) *Attorney, Agent, or Firm*—Oliff & Berridge, PLC

(57) ABSTRACT

A vapour compression device including an internal heat exchanger, a low-pressure compressor and an associated gas cooler, a fluid distributor separating the fluid into a main circuit of the cycle and into an auxiliary cooling circuit of the cycle, an auxiliary expansion system placed on the auxiliary cooling circuit, and a main expansion system placed on the main circuit of the cycle. The device also includes a high-pressure compressor and an associated gas cooler placed on the main circuit of the cycle. A method for performing a transcritical fluid cycle including a substantially isentropic compression step of the fluid, on the main circuit of the cycle, to reach a maximum high pressure greater than a critical pressure of the fluid, and an isobaric cooling step of the fluid to substantially reach a cold source temperature.

15 Claims, 4 Drawing Sheets

VAPOUR COMPRESSION DEVICE AND METHOD OF PERFORMING AN ASSOCIATED TRANSCRITICAL CYCLE

BACKGROUND OF THE INVENTION

The invention relates to a vapour compression device for a transcritical fluid cycle, comprising at least:

- an internal heat exchanger,
- a first vapour compression system connected to the outlet of the internal heat exchanger,
- a first isobaric cooling system connected to the outlet of the first vapour compression system,
- a fluid distributor placed at the outlet of first isobaric cooling system and separating the fluid into a main circuit of the cycle and an auxiliary cooling circuit of the cycle,
- an auxiliary expansion system placed on the auxiliary cooling circuit between the fluid distributor and the inlet of the internal heat exchanger,
- a main expansion system placed on the main circuit and connected to the outlet of the internal heat exchanger,
- an evaporator operating at low pressure placed between the outlet of the main expansion system and the inlet of the internal heat exchanger.

The invention also relates to a method of performing a transcritical fluid cycle between a hot source temperature and a cold source temperature by means of one such vapour compression device, comprising at least the steps of:

- heating the fluid in the internal heat exchanger until the hot source temperature is reached,
- compression of the fluid to reach a medium pressure and to reach the hot source temperature,
- separation of the fluid by the fluid distributor into a main circuit of the cycle and an auxiliary cooling circuit of the cycle,
- expansion of the fluid on the auxiliary cooling circuit by the auxiliary expansion system until the cold source temperature is reached,
- expansion of the fluid on the main circuit by the main expansion system until the cold source temperature is reached,
- isobaric evaporation of the fluid on the main circuit.

STATE OF THE ART

In conventional manner, a thermodynamic cooling cycle, or vapour compression cycle, using carbon dioxide $CO_2$ as refrigerant, operates between a hot source temperature $T_C$ and a cold source temperature $T_F$. The hot source temperature is the minimum temperature at which the refrigerant can discharge heat, whereas the cold source temperature is the maximum temperature at which the refrigerant can absorb heat. The critical temperature $T_{crit}$ of $CO_2$ is 31.1° C. Above this temperature, $CO_2$ is neither in liquid state nor in gaseous state, but in supercritical state in the form of a dense gas.

However, in most cold production (refrigerator mode) or heat production (heat pump mode) applications, the heat discharge temperature is higher than the critical temperature of $CO_2$. A $CO_2$ vapour compression cycle will therefore generally operate between a "subcritical" cold source temperature and a "supercritical" hot source temperature. Such a cycle is then commonly called "transcritical".

For example purposes, FIG. 1 represents an enthalpy diagram (also called enthalpy chart) of the pressure P versus enthalpy h of a conventional version, called Evans-Perkins version, of a transcritical vapour compression cycle according to the prior art. As the cycle uses carbon dioxide $CO_2$, with or without an internal heat exchanger, the temperature conditions are as follows, i.e. a hot source temperature $T_C$ of 35° C. and a cold source temperature $T_F$ of 0° C.

The transcritical vapour compression cycle according to Evans-Perkins, represented schematically by an unbroken line passing through points 1 to 4 in FIG. 1, operates according to the following four transformations.

Between points 1 and 2, the cycle comprises a first step 1-2 of isentropic compression of the fluid, i.e. without losses. During this transformation, the $CO_2$ in saturated vapour state (point 1) is compressed from low-pressure (LP) level to high-pressure (HP) level, by means of a compressor for example. In FIG. 1, $w_C$ represents the compression mass work.

Between points 2 and 3, the cycle comprises a second step 2-3 of isobaric cooling of the fluid. During this transformation, the $CO_2$ on outlet from the compressor (point 2) is cooled substantially to the hot source temperature $T_C$ (point 3). A temperature slide takes place, as the fluid is monophasic, i.e. there is no condensation. Step 2-3 is performed for example using a gas cooler.

Between points 3 and 4, the cycle comprises a step 3-4 of isenthalpic expansion of the fluid, i.e. without work exchange or heat exchange. During this transformation, the pressure of the supercritical $CO_2$ is reduced to low-pressure level by means for example of an expansion valve, where it takes the form of a liquid-vapour mixture (point 4).

Between points 4 and 1, the cycle loops back via an evaporation step 4-1 by means of a evaporator for example. During this transformation, the liquid phase of the $CO_2$ is totally evaporated, which corresponds to a heat absorption. In FIG. 1, $q_R$ represents the cooling mass capacity.

$CO_2$, when it is used in such a cycle, has a lower efficiency than that of conventional refrigerants, of Freon type, used in a "subcritical" cycle operating between the same hot source temperature $T_C$ and cold source temperature $T_F$. Two major reasons can be put forward. The first is that the mean heat discharge temperature is higher for a given hot source temperature $T_c$, as this discharge does not take place at constant temperature. The second reason is that large irreversibilities are observed during isenthalpic expansion (step 3-4), i.e. expansion losses, in the form of unrecovered work and an equivalent decrease of the cooling capacity $\delta w$ (FIG. 1).

To improve the performance of $CO_2$, the thermodynamic cooling cycle therefore has to be adapted. Three types of modifications are generally proposed. The first modification consists in making the compression of step 1-2 isothermal and not isentropic, in order to reduce the compression mass work $w_C$. This can be achieved by performing staged compression, with in particular the addition of an intermediate gas cooler.

The second modification consists in recovering the expansion work to perform isentropic and not isenthalpic expansion between points 3 and 4 of the cycle. For example, spiro-orbital systems, systems using pistons, screws, ejectors, and other systems can be used.

The third modification consists in cooling the $CO_2$ on outlet of the gas cooler (point 3 in FIG. 1), in particular so as to reduce the expansion losses. To make this modification, an internal heat exchanger can be used. In FIG. 1, such a modification corresponds to the cycle passing via points 1' to 4'. The high-pressure $CO_2$ has to be cooled between points 3 and 3' by superheating the saturated vapour recovered at the end of evaporation, i.e. between points 1 and 1'. In this case, the increase of the compression work between points 1' and 2' is compensated by a larger increase of the cooling capacity between points 4' and 1.

However, the heat exchange is limited by the mass heat difference between the $CO_2$ at high pressure and the $CO_2$ at low pressure. In other words, even if the internal heat exchanger is assumed to be perfect, i.e. presenting a temperature at point 1' equal to the temperature at point 3 (FIG. 1), the $CO_2$ can not be cooled to the lowest temperature, i.e. the cold source temperature $T_F$ or evaporation temperature.

The expansion losses can therefore be further reduced provided that the temperature of the $CO_2$ approaches the cold source temperature $T_F$ before the isenthalpic expansion step 3-4, as represented schematically by the arrows between points 3' and 3" and 4' and 4" in FIG. 1.

A first solution has been proposed, in particular in the article "Revival of carbon dioxide as a refrigerant" by G. Lorentzen (1994, International Journal of Refrigeration, 17(5), pp. 292-301), which describes the use of $CO_2$ as its own refrigerant to cool it before pressure reduction. For this, a cycle with a fractioned fluid is used, which gives rise to staged compression.

As represented in the enthalpy chart of FIG. 2 illustrating the thermodynamic cycle according to the solution proposed by Lorentzen, the principle consists in using a mass fraction y of the $CO_2$ on outlet from the gas cooler, i.e. at point 6 in FIG. 2, in an auxiliary cooling circuit performing cooling of the complementary remaining mass fraction 1−y of $CO_2$ circulating in a main circuit of the cycle.

In FIG. 2, the cycle comprises a $CO_2$ heating step 1-2 followed by an isentropic compression step 2-3 and an isobaric cooling step 3-4. Then, according to Lorentzen's cycle, a new isentropic compression step 4-5 is performed, followed by a new isobaric cooling step 5-6, to reach the hot source temperature $T_C$. The fluid is then separated into two and the pressure of the mass fraction of fluid following the auxiliary cooling circuit represented in a broken line in FIG. 2 is then reduced between points 6 and 10 of the cycle until an intermediate pressure $P_{int}$ is reached.

The two-phase mixture is then evaporated and then superheated between points 10 and 4 of the cycle, until the hot source temperature $T_C$ is reached, a temperature at which the $CO_2$ at high pressure is outlet from the gas cooler. The mass fraction is in particular determined therein so that the complementary mass fraction 1−y of $CO_2$ at high pressure on outlet from the cooler reaches the saturation temperature $T_{sat}$ intermediate pressure, i.e. the temperature at point 7 and at point 10, about 17.83° C. The mass fraction 1−y of $CO_2$ at high pressure outlet from the cooler then enters an internal heat exchanger and its temperature decreases further between points 7 and 8 of the cycle. Then the pressure of the mass fraction 1−y of $CO_2$ is reduced between points 8 and 9 of the cycle until it reaches temperature $T_F$.

Such a solution as described above does however present two limits. Firstly, the $CO_2$ at intermediate pressure $P_{int}$, i.e. between points 10 and 4 of FIG. 2, is two-phase and its temperature is constant, which results in the cooler in a temperature difference with the $CO_2$ at high pressure and therefore in irreversibilities. Secondly, the fluid inlet to the expansion valve designed to perform the expansion step on the main circuit of the cycle (point 8 of the cycle of FIG. 2) can not reach the cold source temperature $T_F$.

Another solution using a fluid as its own refrigerant in a liquefaction cycle has also been proposed in the article "Refrigeration Carnot-type cycle based on isothermal vapour compression" by F. Meunier (2006, International Journal of Refrigeration, 29, pp. 155-158). The article describes adaptation of the Claude liquefaction cycle for use as transcritical refrigeration cycle. A particular embodiment of a vapour compression device 11 for performing a cycle according to Meunier is represented schematically in FIG. 3.

In FIG. 3, vapour compression device 11 comprises an internal heat exchanger 12, a compressor 13 connected to the outlet of heat exchanger 12, a gas cooler 14 connected to the outlet of compressor 13, and a fluid distributor (point 4 of FIG. 3) separating the cycle into a main circuit 1−y and an auxiliary cooling circuit y. Auxiliary cooling circuit y comprises an auxiliary expansion system 15, for example a turbine, connected to the inlet of internal heat exchanger 12 so as to form a cooling loop, and main circuit 1−y, preferably passing by means of heat exchanger 12 connected to the outlet of the fluid distributor, comprises a main expansion system 16, for example a expansion valve, connected to the outlet of heat exchanger 12.

In the particular embodiment of FIG. 3, flow of the fluid in heat exchanger 12 on main circuit 1−y in particular enables the temperature of the high-pressure $CO_2$ to be reduced as far as possible before the latter passes through main expansion system 16, in order to reduce the irreversibilities associated with pressure reduction. Moreover, main circuit 1−y also comprises an evaporator 17, operating at low pressure, connected to the outlet of main expansion system 16 and to the inlet of internal heat exchanger 12, and consequently to the outlet of auxiliary expansion system 15 (point 1 of FIG. 3).

In FIG. 4, representing an enthalpy chart illustrating the cycle according to Meunier's principle by means of vapour compression device 11 as described above, the mass heat difference between the fluid at high pressure ($CO_2$) and the fluid at low pressure is compensated by a difference of mass flowrate in the internal heat exchanger.

The cycle conventionally comprises a heating step 1-2 between points 1 and 2 of the cycle (FIGS. 3 and 4) by means of internal heat exchanger 12 (FIG. 3) until hot source temperature $T_C$ is reached, followed by an isentropic compression step 2-3 by means of compressor 13 operating at low pressure (FIG. 3). Then an isobaric cooling step 3-4 is performed by means of isobaric gas cooler 14 between points 3 and 4 of the cycle until hot source temperature $T_C$ is again reached (FIG. 3). After it has passed in gas cooler 14, the fluid at high pressure is then split into two parts by means of the fluid distributor (point 4 of FIG. 4). In a first main circuit, a mass fraction 1−y of fluid is cooled in an isobaric cooling step 4-5 by means of internal heat exchanger 12 until a temperature close to cold source temperature $T_F$ is reached (FIG. 4).

A remaining mass fraction y of fluid is used in an auxiliary second cooling circuit, i.e. a refrigeration "sub-cycle" passing via points 1 to 4, commonly called reverse Brayton cycle. In FIG. 4, mass fraction y then has to meet the following requirement: $(1-y)(h_4-h_5)=h_2-h_1$.

Initially, the cycle proposed by Meunier is an ideal cycle composed of isothermal compression (with heat discharge) and isothermal expansion (with heat absorption). In FIG. 4, an isentropic compression between points 2 and 3 of the cycle and an isenthalpic expansion between points 5 and 6 of the cycle are represented, these steps being closer to the implemented technological reality of the cycle. The expansion of mass fraction y of the fluid between points 4 and 1 of the cycle is isentropic, i.e. the work is recovered. If this was not the case, the Coefficient Of Performance (COP) would be disadvantageous, in particular lower than the coefficient of performance obtained in an Evans-Perkins cycle as described previously.

For the cycle to be able to operate, the fluid vapour at low pressure, in particular the $CO_2$, entering heat exchanger 12 of FIG. 3, must not be superheated, otherwise the $CO_2$ at high pressure can not reach the minimum temperature, that of evaporator 17, i.e. cold source temperature $T_F$. The pressure before expansion between points 4 and 1 of the cycle, i.e. the high pressure $P_{HP}$, can therefore not drop below a certain threshold called the minimum pressure $P_{min}$. This is the configuration of FIG. 4 in which the high pressure $P_{HP}$ is equal to the minimum pressure $P_{min}$.

However under such conditions, an increase of the high pressure $P_{HP}$ can result in a reduction of the efficiency, for on the one hand the compression work is greater, and on the other hand point 1 of the cycle moves underneath the saturator bell, i.e. under the parabola representative of the $CO_2$ phase diagram delineating the different states (solid, liquid, gaseous) of the $CO_2$. This results in the $CO_2$ being two-phase between points 1 and 2 of the cycle, which increases the irreversibilities in internal heat exchanger 12.

Moreover, for as low as possible a hot source temperature $T_C$, generally comprised between 10° C. and 50° C., Meunier's cycle described above is not suitable, the cycle presents two phases of the fluid (liquid and vapour) for in certain sections, in particular in heat exchanger 12. A single-phase state of the fluid is therefore not possible in the whole heat exchanger 12, especially if hot source temperature $T_C$ is lower than 56° C. Above 56° C., the fluid is in fact only single-phase in heat exchanger 12, but the price to pay is an excessive energy consumption and a lesser cycle efficiency, the discharges being at temperatures that are not acceptable, i.e. that are too high, typically about 56° C. for $CO_2$.

OBJECT OF THE INVENTION

One object of the invention is to remedy all the above-mentioned shortcomings and has the object of providing a vapour compression device, for a transcritical fluid cycle, whereby the irreversibilities in the internal heat exchanger can be reduced so as to obtain an improved cycle efficiency, while at the same time ensuring that the refrigerant, in particular carbon dioxide, remains single-phase in the whole of the internal heat exchanger.

The object of the invention is achieved by the accompanying claims.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 5:
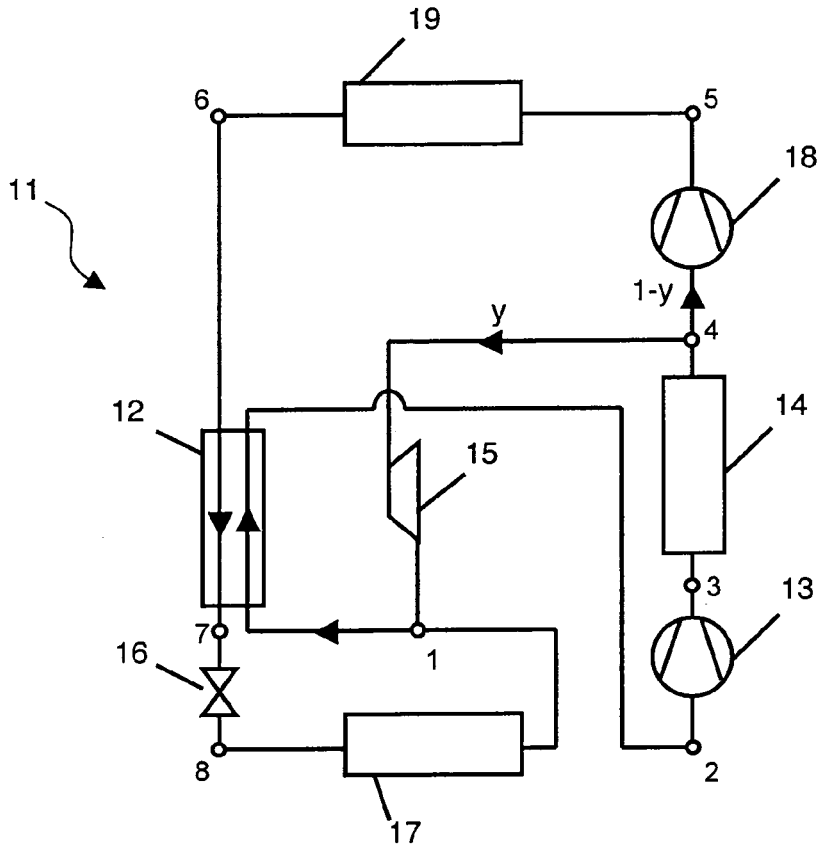
FIG. 5 schematically represents a vapour compression device according to the invention for performing a transcritical fluid cycle according to the invention.
Figure 6:
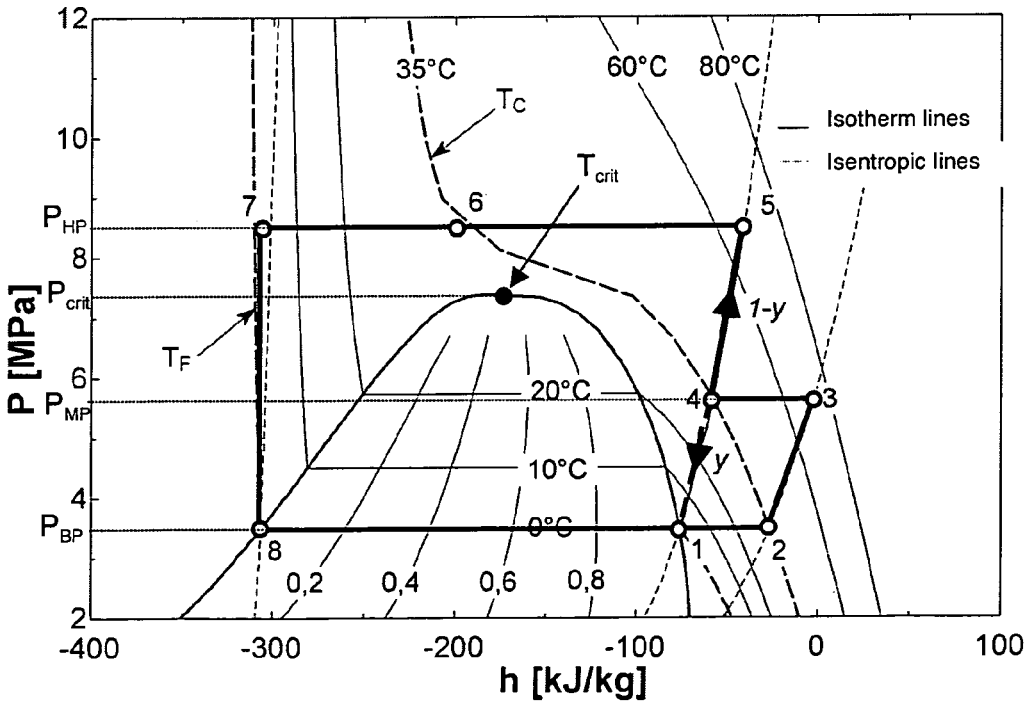
FIG. 6 represents an enthalpy chart illustrating a transcritical fluid cycle according to the invention performed by means of a vapour compression device according to FIG. 5.
Figure 7:
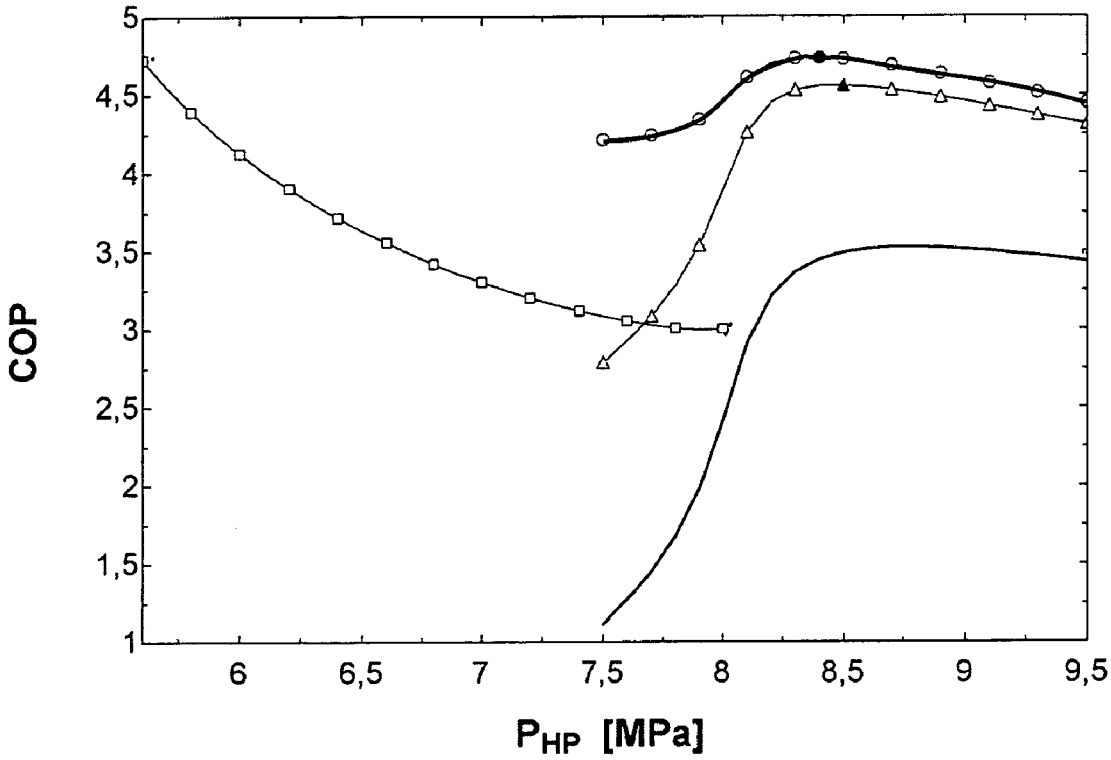
FIG. 7 represents a diagram of the coefficient of performance versus the high pressure for the transcritical fluid cycle according to FIGS. 5 and 6.

With reference to FIGS. 5 to 7, the vapour compression device 11 according to the invention (FIG. 5) concerns a new refrigeration thermodynamic cycle, i.e. a vapour compression cycle. It is in particular suitable for the use of carbon dioxide $CO_2$ as refrigerant. The interest shown in $CO_2$ stems from its low environmental impact with regard to the fluorinated synthetic refrigerants usually used, freons, certain of which destroy the ozone layer and others are greenhouse effect gases (generally more than a thousand times more powerful than $CO_2$). $CO_2$ is in addition neither toxic nor flammable.

Figure 1:
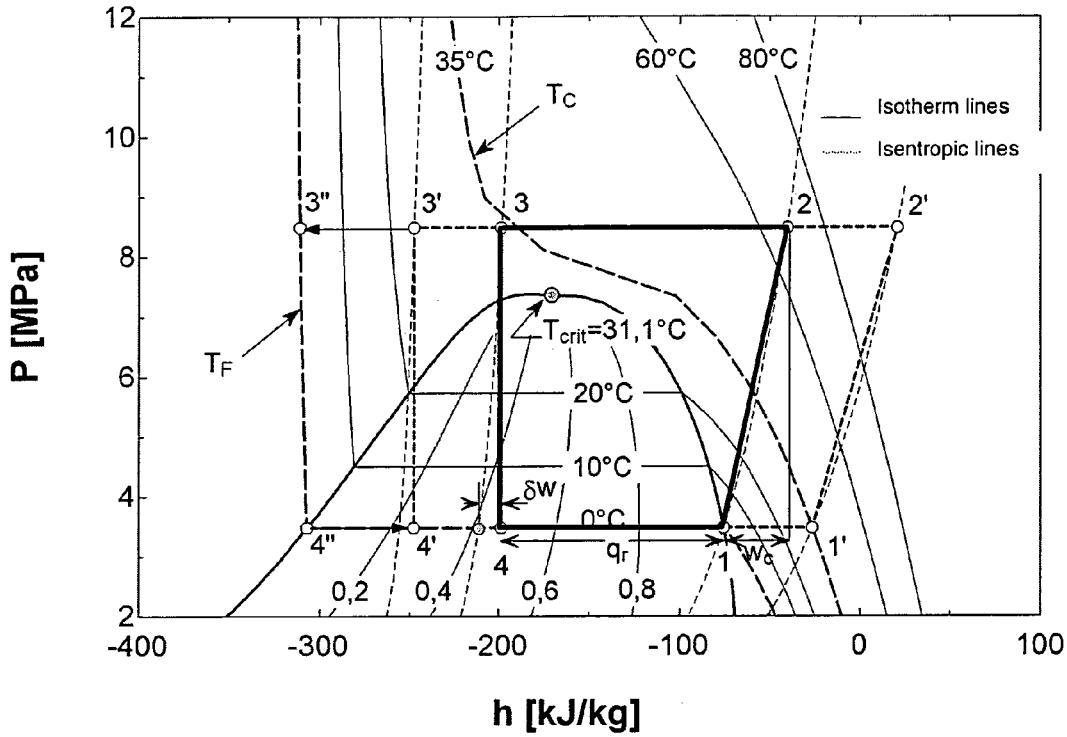
FIG. 1 (prior art)
FIG. 1 represents an enthalpy chart according to the prior art illustrating a transcritical fluid cycle according to Evans-Perkins.
Figure 2:
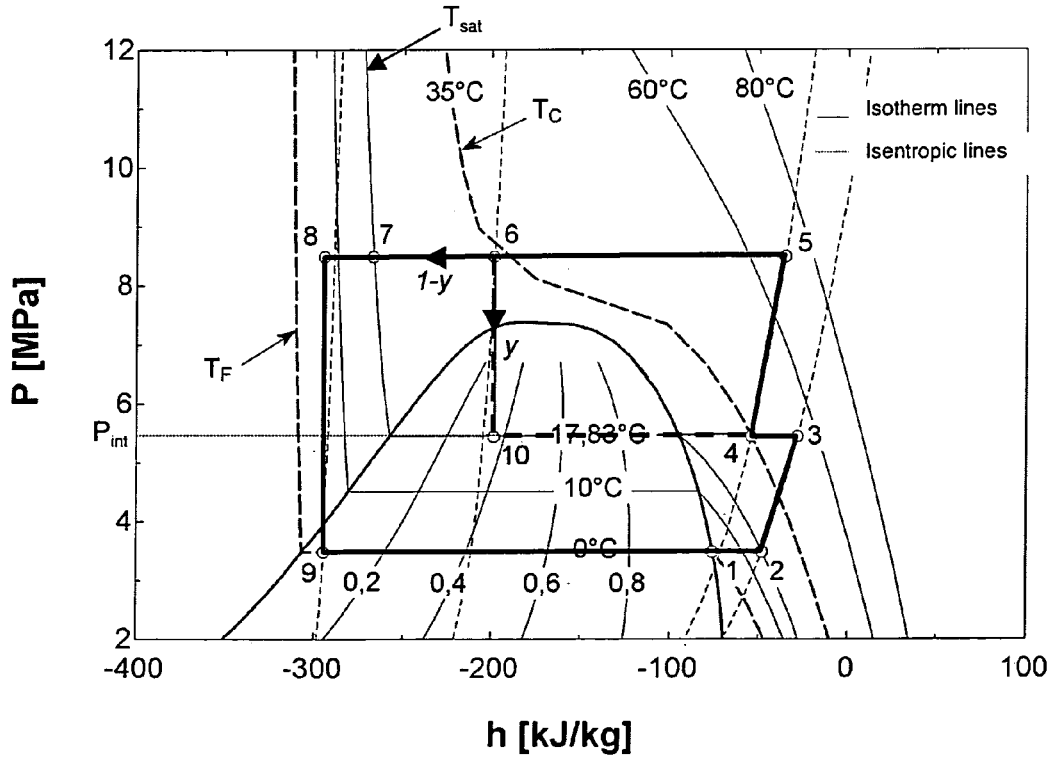
FIG. 2 (prior art)
FIG. 2 represents an enthalpy chart according to the prior art illustrating a transcritical fluid cycle according to Lorentzen.
Figure 3:
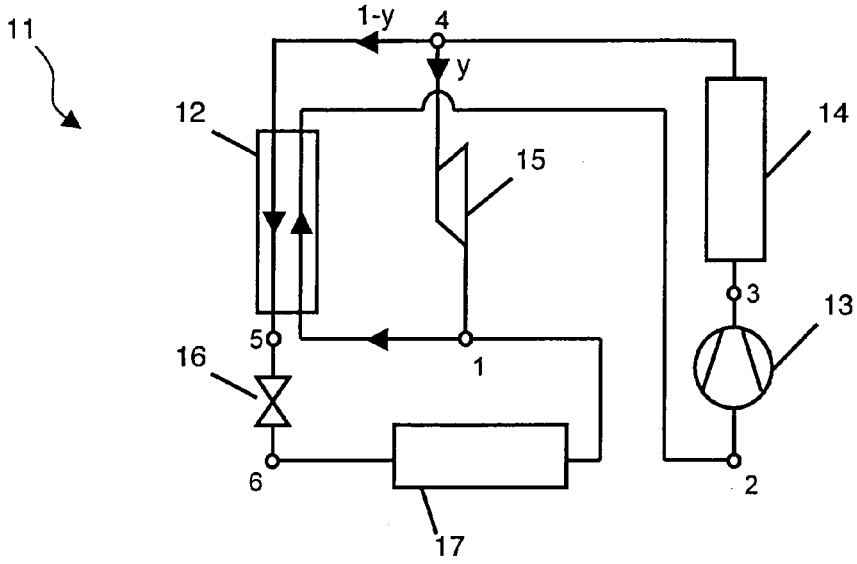
FIG. 3 (prior art)
FIG. 3 schematically represents a vapour compression device according to the prior art for performing a transcritical fluid cycle according to Meunier.

In FIG. 5, a particular embodiment of vapour compression device 11 is represented in schematic form. Device 11 differs from the device according to Meunier's cycle (FIG. 3) by the addition of a compressor 18, operating at high pressure, on the main circuit 1−y of the cycle. The new compression stage defined by high-pressure compressor 18 then requires the addition of an associated isobaric second gas cooler 19 placed on main fluid circuit 1−y, after the fluid distributor (point 4 in FIG. 5), between the outlet of high-pressure compressor 18 and the inlet of internal heat exchanger 12.

Vapour compression device 11 comprises the same elements as the device according to Meunier's cycle with an internal heat exchanger 12, a low-pressure compressor 13, an associated isobaric gas cooler 14, an auxiliary expansion system 15 (also called auxiliary pressure reducing system), on the auxiliary cooling circuit y of the cycle, a main expansion system (also called main pressure reducing system) 16 on main circuit 1−y of the cycle, and an evaporator 17 operating at low pressure. Operation of the device is the same with a fluid distributor, more particularly a $CO_2$ distributor, placed at point 4 of the cycle (FIG. 5) to separate the fluid so that a mass fraction y of the fluid follows the auxiliary cooling cycle and in particular enables the fluid of the main circuit 1−y to be cooled at the inlet of internal heat exchanger 12.

In FIG. 5, auxiliary expansion system 15 and main expansion system 16 can be simple systems, of the valve or capillary type, etc. In alternative embodiments, not represented, auxiliary 15 and main 16 expansion systems can each be associated with, or can even be replaced by a respectively auxiliary and main work recovery system, more particularly an expansion work recovery system. For example, the auxiliary and main work recovery systems can be positive movement machines, of piston type, or non-positive movement machines, of turbine type. The auxiliary and main work recovery systems are independent and work can be recovered on one and/or the other of the systems.

Moreover, such auxiliary and main work recovery systems can advantageously be mechanically and/or electrically coupled with one and/or the other of low-pressure 13 and high-pressure 18 compressors (FIG. 5), in particular to lighten the energy consumption of vapour compression device 11.

In FIGS. 5 and 6, high-pressure compressor 18 serves the purpose in particular of increasing the pressure of the $CO_2$ flowing in heat exchanger 12 so that it is supercritical, i.e. so that it has a higher temperature than the critical temperature $T_{crit}$ of about 31.1° C. (FIG. 6).

Figure 4:
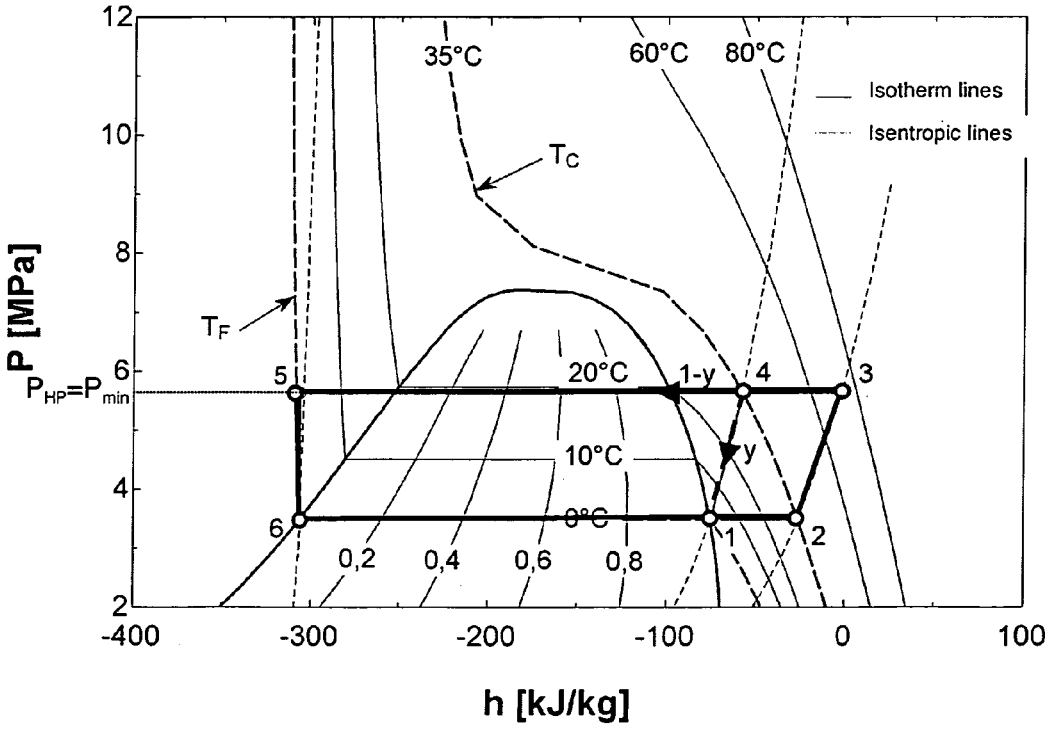
FIG. 4 (prior art)
FIG. 4 represents an enthalpy chart according to the prior art illustrating a transcritical fluid cycle according to Meunier performed by means of a vapour compression device according to FIG. 3.

Unlike Meunier's cycle (FIG. 4), such a device then enables the pressure of the $CO_2$ at the outlet of high-pressure compressor 18 to be increased, so that the corresponding isobaric cooling between points 6 and 7 takes place under supercritical conditions, as described hereafter, i.e. so that the $CO_2$ is single-phase, i.e. it passes above the parabola representative of the $CO_2$ phase diagram representing the saturator bell delineating the different states (solid, liquid, gaseous) of the $CO_2$ (FIG. 4).

A method for performing a transcritical fluid cycle, more particularly using $CO_2$, by means of vapour compression device 11 represented in FIG. 5 will be described in greater detail with regard to FIG. 6, representing an enthalpy chart of the pressure versus the enthalpy, between a hot source temperature $T_C$ of 35° C. and a cold source temperature $T_F$ of 0° C. The cycle comprises a heating step 1-2 between points 1 and 2 of the cycle by means of internal heat exchanger 12 (FIG. 5) until the hot source temperature $T_C$ is reached, followed by a compression step 2-3, which is preferably isentropic, by means of low-pressure compressor 13 (FIG. 5). Then a preferably isobaric cooling step 3-4 of the $CO_2$ is performed between points 3 and 4 of the cycle by means of isobaric gas cooler 14 (FIG. 5), until hot source temperature $T_C$ is reached again at point 4 of the cycle.

The $CO_2$ is then split into two at point 4 of device 11 (FIG. 5) by means of the fluid distributor to obtain a mass fraction 1−y of $CO_2$ in a first main circuit, and a mass fraction y of $CO_2$ in a second auxiliary cooling circuit, which fraction is used in a cooling "sub-cycle" between points 1 to 4 of the cycle. As previously for Meunier's cycle, the mass fraction y meets the following requirement: $(1-y)\cdot(h_6-h_7)=h_2-h_1$.

After isobaric cooling step 3-4, the $CO_2$ is then at a medium pressure $P_{MP}$, or intermediate pressure, and at hot source temperature $T_C$. Medium pressure $P_{MP}$ is chosen such that mass fraction y of $CO_2$, after the latter has passed through auxiliary expansion system 15 which is connected to the low-pressure inlet of internal heat exchanger 12 of the cycle (FIG. 5), i.e. after step 4-1 of expansion of the mass fraction y of $CO_2$, can be mixed with the remaining mass fraction 1−y of $CO_2$ outlet from evaporator 17 to reach a superheated vapour state (FIG. 5) which is as close as possible to saturated vapour state. Point 1 of the cycle represented in FIG. 6 is then advantageously located on the parabola representative of the $CO_2$ phase diagram representing the saturation curve delineating the different states (solid, liquid, gaseous) of the $CO_2$.

Expansion step 4-1 described above, on auxiliary cooling circuit y, can be isenthalpic or isentropic. In addition, as the cycle runs continuously, the steps below relating to main circuit 1−y of the cycle are performed at the same time as expansion step 4-1 performed on auxiliary cooling circuit y.

In the main circuit, mass fraction 1−y of $CO_2$ then passes through high-pressure compressor 18 to undergo a preferably isentropic compression step 4-5 between points 4 and 5 of the cycle (FIGS. 5 and 6). High-pressure compressor 18 in particular enables the $CO_2$ to be discharged at a supercritical maximum high pressure $P_{HP}$ that is greater than the critical pressure $P_{crit}$ of $CO_2$, at which the $CO_2$ has a very high temperature, typically greater than 60° C. (point 5 of the cycle). The $CO_2$ is then in a supercritical state, i.e. it passes above the parabola representative of the $CO_2$ phase diagram associated with the critical temperature $T_{crit}$, representing the $CO_2$ saturation bell delineating the different states (solid, liquid, gaseous) of the $CO_2$.

Then, between points 5 and 6 of the cycle, the $CO_2$ is subjected to a preferably isobaric cooling step 5-6 by means of associated gas cooler 19, connected to the outlet of high-pressure compressor 18, until hot source temperature $T_C$ is again reached at point 6 of the cycle.

Then, between points 6 and 7 of the cycle (FIGS. 5 and 6), the $CO_2$ passes through internal heat exchanger 12 again, on main circuit 1−y of the cycle, which then performs a preferably isobaric cooling step 6-7 of the mass fraction 1−y of $CO_2$ at high pressure outlet from high-pressure compressor 18 and associated gas cooler 19. Such a step brings the temperature of the $CO_2$ down below the hot source temperature $T_C$, until cold source temperature $T_F$, i.e. 0° C., is substantially reached.

An isenthalpic or isentropic expansion step 7-8 is then performed by means of main expansion system 16, on main circuit 1−y of the cycle, to make the $CO_2$ go from high pressure value $P_{HP}$ to a low pressure value $P_{BP}$.

Finally the fluid passes through evaporator 17, operating at low pressure, to complete the cycle by an isobaric evaporation step 8-1, until point 1, the point of departure of the cycle, is reached at cold source temperature $T_F$.

It is therefore the mixture of $CO_2$ at low pressure outlet from evaporator 17 of main circuit 1−y and of the $CO_2$ at low pressure outlet from auxiliary expansion system 15 of auxiliary cooling circuit y which is heated at the start of the cycle in internal heat exchanger 12, before being driven into low-pressure compressor 13.

For example purposes, for a cold source temperature $T_F$ of about 0° C., for a hot source temperature $T_C$ of 35° C. and for a critical pressure $P_{crit}$ of about 7.5 MPa, medium pressure $P_{MP}$ is about 5.5 MPa and high pressure $P_{HP}$ is about 8.4 MPa (FIGS. 6 and 7).

Such a method of performing a transcritical $CO_2$ cycle by means of such a vapour compression device 11 (FIG. 5) therefore enables the main cooling cycle to be made to operate at a high pressure $P_{HP}$ greater than the critical pressure $P_{crit}$, whereas the auxiliary cooling circuit operates at a medium pressure $P_{MP}$, lower than high pressure $P_{HP}$.

Furthermore, such a vapour compression device 11, with a staged compression system formed by low-pressure compressor 13 and high-pressure compressor 18, is very simple to implement with the simple addition of two elements on main circuit 1−y of the cycle (compressor and gas cooler operating at high pressure). Such a vapour compression device 11 therefore enables a transcritical fluid cycle to be obtained, more particularly using $CO_2$, with an enhanced efficiency of internal heat exchanger 12, notably by the use of a single-phase fluid, which results in a minimum temperature difference between the low-pressure side and the high-pressure side of vapour compression device 11 according to the invention.

In this respect, FIG. 7 represents a graph illustrating the variation of the Coefficient Of Performance COP versus the value of the high pressure $P_{HP}$ for different transcritical cycles, i.e. according to Evans-Perkins (simple unbroken line curve), according to Lorentzen (curve with triangles), according to Meunier (curve with squares) and according to the invention (curve with circles). It can be observed from FIG. 7 that the performance of the transcritical cycle according to the high pressure $P_{HP}$ can be optimized for the hot source temperature value $T_C$ of 35° C. and the cold source temperature value $T_F$ of 0° C.

When observing the curve corresponding to the cycle according to the invention (curve with circles), the COP reaches a maximum (black circle) at a pressure $P_{HP}$ of about 8.4 MPa, thus achieving a relative improvement of about 34.4% compared with the basic Evans-Perkins cycle (simple unbroken line curve) and of about 3.9% compared with the Lorentzen cycle (curve with triangles).

The invention is not limited to the different embodiments described above. Generally speaking, there are several possible paths to go from one point to another of the transcritical cycle according to the invention, the fluid being able to follow the isobaric curves, the isothermal curves, the isenthalpic curves or the isentropic curves in the enthalpy diagram as represented in FIG. 6. In a general manner, the method can in particular comprise a single fluid compression step 2-4 to reach medium pressure $P_{MP}$ and to reach hot source temperature $T_C$, and a single fluid compression step 4-6 to reach maximum high pressure $P_{HP}$, greater than the critical pressure $P_{crit}$ of the fluid, and to reach cold source temperature $T_C$.

The low-pressure compressor 13 and high-pressure compressor 18 and low-pressure gas cooler 14 and high-pressure gas cooler 19 can be any vapour compression system and any gas cooling system able to operate at high pressure and/or at low pressure, depending on their places in the circuit associated with vapour compression device 11.

Vapour compression device 11 according to the invention can in particular comprise any type of vapour compression system, any type of isobaric cooling system, any type of cooling system simultaneous with a compression, any type of fluid distributor, any auxiliary expansion system for the auxiliary cooling circuit and any main expansion system for the main circuit, so long as the vapour compression device enables in particular a single-phase fluid to be had on both sides of internal heat exchanger 12 in order to reduce the irreversibilities in internal heat exchanger 12 while at the same time keeping the temperature of the fluid at high pressure on outlet from heat exchanger 12 as close as possible to cold source temperature $T_F$.

We claim:

1. A vapour compression device for a transcritical fluid cycle comprising at least: an internal heat exchanger, a first vapour compression system connection to an outlet of the internal heat exchanger, a first isobaric cooling system —having an inlet and an outlet and being—connected to an outlet of the first vapor compression system, a fluid distributor placed at —the—outlet of the first isobaric cooling system that separates the fluid into a main circuit of the cycle and an auxiliary cooling circuit of the cycle, an auxiliary expansion system placed on the auxiliary cooling circuit between the fluid distributor and an inlet of the internal heat exchanger, a main expansion system placed on the main circuit and connected to the outlet of the internal heat exchanger, an evaporator operating at low pressure placed between an outlet of the main expansion system and the inlet of the internal heat exchanger, a second vapour compression system, and a second isobaric cooling system connected to an outlet of the second vapour compression system, wherein the second vapour compression system and the second isobaric cooing system are placed on the main circuit of the cycle after the fluid distributor and before the inlet of the internal heat exchanger, and the fluid separated into the auxiliary cooling circuit by the fluid distributor flows serially from the fluid distributor through the auxiliary expansion system and into the internal heat exchanger.

2. The device according to claim 1, wherein the fluid is carbon dioxide.

3. The device according to claim 1, wherein the isobaric cooling systems are gas coolers.

4. The device according to claim 1, wherein the main expansion system is associated with a main work recovery system.

5. The device according to claim 4, comprising mechanical and/or electrical coupling means between said main work recovery system and the first vapour compression system and/or the second vapour compression system.

6. The device according to claim 1, wherein the auxiliary expansion system is associated with an auxiliary work recovery system.

7. The device according to claim 6, comprising mechanical and/or electrical coupling means between said auxiliary work recovery system and the first vapour compression system and/or the second vapour compression system.

8. The device according to claim 1, wherein the internal heat exchanger is connected to an outlet of the second isobaric cooling system and to an inlet of the main expansion system on the main circuit of the cycle.

9. The device according to claim 1, wherein pressure in the main circuit of the cycle is a maximum high pressure greater than the critical pressure of the fluid.

10. The device according to claim 9, wherein pressure in the auxiliary cooling circuit of the cycle is a medium pressure of the fluid, lower than said maximum high pressure.

11. A method for performing a transcritical fluid cycle between a hot source temperature and a cold source temperature, by means of the vapour compression device according to claim 1, comprising at least the steps of:

heating the fluid in the internal heat exchanger until a hot source temperature is reached, compressing the fluid to reach a medium pressure and to reach the hot source temperature, separating the fluid by the fluid distributor into the main circuit of the cycle and the auxiliary cooling circuit of the cycle, expanding the fluid on the auxiliary cooling circuit, by means of the auxiliary expansion system, until the cold source temperature is reached, expanding the fluid on the main circuit, by means of the main expansion system, until the cold source temperature is reached, performing isobaric evaporation of the fluid on the main circuit, wherein the method comprises compressing the fluid on the main circuit of the cycle, after the fluid separating step and before the associated expanding step, to reach a maximum high pressure, greater than a critical pressure of the fluid, and to substantially reach the hot source temperature, and a cooling step of the fluid to substantially reach the cold source temperature.

12. The method according to claim 11, wherein the compressing of the fluid to reach the medium pressure and to reach the hot source temperature comprises the steps of:

performing substantially isentropic compression of the fluid by the first vapour compression system to reach said medium pressure, and performing isobaric cooling of the fluid by the first isobaric cooling system to reach the hot source temperature.

13. The method according to claim 11, wherein the expanding step of the fluid on the auxiliary cooling circuit of the cycle is isenthalpic or isentropic.

14. The method according to claim 11, wherein the expanding step of the fluid on the main circuit of the cycle is isenthalpic or isentropic.

15. The method according to claim 11, wherein the compressing step of the fluid, to reach a maximum high pressure greater than a critical pressure of the fluid, and to substantially reach the hot source temperature, comprises substantially isentropic compression of the fluid followed by isobaric cooling of the fluid.

* * * * *

UNITED STATES PATENT AND TRADEMARK OFFICE

CERTIFICATE OF CORRECTION

PATENT NO. : 7,818,978 B2
APPLICATION NO. : 11/984800
DATED : October 26, 2010
INVENTOR(S) : Maxime Ducoulombier et al.

It is certified that error appears in the above-identified patent and that said Letters Patent is hereby corrected as shown below:

Claim 1, column 9, line 31 change "connection" to --connected--.

Claim 1, column 9, lines 32-33 change "a first isobaric cooling system—hav-ing an inlet and an outlet and being—connected to an outlet" to:

--a first isobaric cooling system having an inlet and an outlet and being connected to an outlet--.

Claim 1, column 9, line 35 change "at—the—outlet of the first isobaric" to:

--at the outlet of the first isobaric--.

Signed and Sealed this
Fourth Day of January, 2011

David J. Kappos

David J. Kappos
*Director of the United States Patent and Trademark Office*